US012454436B2

(12) United States Patent
Ogino et al.

(10) Patent No.: US 12,454,436 B2
(45) Date of Patent: Oct. 28, 2025

(54) IMAGE FORMING APPARATUS THAT CAN FORM IMAGES ON BOTH SIDES OF SHEET

(71) Applicant: CANON KABUSHIKI KAISHA, Tokyo (JP)

(72) Inventors: Kosuke Ogino, Shizuoka (JP); Hiroshi Hagiwara, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 18/444,011

(22) Filed: Feb. 16, 2024

(65) Prior Publication Data

US 2024/0279011 A1 Aug. 22, 2024

(30) Foreign Application Priority Data

Feb. 20, 2023 (JP) ..... 2023-024623

(51) Int. Cl.
*B65H 85/00* (2006.01)
*B65H 5/06* (2006.01)

(52) U.S. Cl.
CPC ..... *B65H 85/00* (2013.01); *B65H 5/062* (2013.01); *B65H 2513/10* (2013.01); *B65H 2701/1311* (2013.01); *B65H 2801/03* (2013.01)

(58) Field of Classification Search
CPC ..... B65H 5/062; B65H 85/00
See application file for complete search history.

(56) References Cited

U.S. PATENT DOCUMENTS

| | | | | |
|---|---|---|---|---|
| 8,585,048 | B2 * | 11/2013 | Yamagishi | B65H 85/00 271/186 |
| 9,682,836 | B2 * | 6/2017 | Kowase | B65H 29/125 |
| 10,642,211 | B2 * | 5/2020 | Deno | B65H 29/60 |
| 11,206,334 | B2 | 12/2021 | Hagiwara | |
| 11,299,360 | B2 | 4/2022 | Katto | |
| 11,659,122 | B2 * | 5/2023 | Ishikawa | G06K 17/0025 358/1.15 |
| 2006/0202407 | A1 * | 9/2006 | Yasui | B65H 5/34 271/226 |
| 2018/0157200 | A1 * | 6/2018 | Endoh | G03G 15/6564 |

FOREIGN PATENT DOCUMENTS

| | | |
|---|---|---|
| JP | 2019-101068 A | 6/2019 |
| JP | 2021-016997 A | 2/2021 |

* cited by examiner

*Primary Examiner* — Patrick Cicchino
(74) *Attorney, Agent, or Firm* — Venable LLP

(57) ABSTRACT

An image forming apparatus includes a first drive source of a first roller and a third roller, a second drive source of a second roller, and a control unit, which is configured to perform a first control of changing a conveying speed of a sheet by the first roller from a reference speed in order to adjust timing at which the sheet reaches an image forming region until a front end of the sheet reaches a first position between the first roller and the image forming region. The control unit is configured to control a feeding timing of a second sheet to be fed to a main conveyance path after a first sheet so that the first control is not executed while the first sheet is being conveyed by both the second roller and the third roller.

12 Claims, 9 Drawing Sheets

IMAGE FORMING APPARATUS THAT CAN FORM IMAGES ON BOTH SIDES OF SHEET

BACKGROUND OF THE INVENTION

Field of the Invention

The present invention relates to an image forming apparatus that can form images on both sides of a sheet.

Description of the Related Art

US-2018-0157200 discloses an image forming apparatus that can form images on both sides of a sheet. Such an image forming apparatus includes a main conveyance path that passes through an image forming region where an image is formed on a sheet, and a sub conveyance path that connects a branch point and a merging point of the main conveyance path. The branch point is located on the downstream side of the main conveyance path with respect to the image forming region, and the merging point is located on the upstream side of the main conveyance path with respect to the image forming region. The sheet on which the image is formed on a first surface in the image forming region is conveyed to the downstream side along the main conveyance path. In a case where images are formed on both sides of a sheet, after a rear end of the sheet passes through a branch point, a conveying direction of the sheet is reversed, and the sheet is conveyed to the sub conveyance path. Thereafter, the sheet is conveyed to the main conveyance path through the merging point, and an image is formed on the second surface. A reversing roller configured to be rotatable in both directions is provided on the downstream side of the branch point for a reversing operation of the conveying direction of the sheet at the branch point.

The image forming apparatus is provided with a plurality of members, for example, a plurality of rollers for conveying a sheet along a conveyance path. One of the plurality of rollers is a registration roller provided between the image forming region and the merging point. The registration roller performs acceleration/deceleration control of increasing/decreasing a conveying speed of the sheet with respect to a reference speed in order to adjust timing of sending the sheet to the image forming region. The plurality of rollers are generally rotationally driven by a plurality of motors (drive sources).

When the peripheral speeds of the plurality of rollers conveying the sheet, that is, the conveying speed of the sheet by each of the plurality of rollers are different, the sheet may be pulled, pushed, or the like, and conveyance failure may occur. For example, when the sheet is simultaneously conveyed by both the first roller driven by the same first drive source as the registration roller and the second roller driven by a second drive source different from the first drive source while the acceleration/deceleration control is performed by the registration roller, the sheet may be pulled, pushed, or the like and conveyance failure may occur. If the conveyance interval of the sheet is increased excessively to suppress the occurrence of conveyance failure, productivity reduces.

SUMMARY OF THE INVENTION

According to an aspect of the present invention, an image forming apparatus includes: a main conveyance path having an image forming region; a sub conveyance path connecting a branch point on a downstream side of the image forming region and a merging point on an upstream side of the image forming region in the main conveyance path; a feeding unit configured to feed a sheet to the main conveyance path; an image forming unit configured to form an image on the sheet conveyed on the main conveyance path in the image forming region of the main conveyance path; a first roller configured to send the sheet to the image forming region; a second roller configured to be rotationally driven in a first direction until a rear end of the sheet in a conveying direction passes beyond the branch point, and rotationally driven in a second direction different from the first direction after the rear end has passed the branch point, to send the sheet to the sub conveyance path; a third roller configured to convey the sheet toward the merging point in the sub conveyance path; a first drive source configured to drive the first roller and the third roller; a second drive source configured to drive the second roller; and a control unit configured to control the first drive source, the second drive source, and the feeding unit. The control unit is configured to perform a first control of changing a conveying speed of the sheet by the first roller from a reference speed in order to adjust timing at which the sheet reaches the image forming region until a front end of the sheet in the conveying direction reaches a first position between the first roller and the image forming region, and control the first drive source so that the conveying speed of the sheet becomes the reference speed after the front end has reached the first position. The control unit is configured to control a feeding timing to the main conveyance path of a second sheet to be fed to the main conveyance path by the feeding unit after a first sheet so that the first control is not executed while the first sheet is being conveyed in the sub conveyance path by both the second roller and the third roller.

Further features of the present invention will become apparent from the following description of exemplary embodiments with reference to the attached drawings.

DESCRIPTION OF THE EMBODIMENTS

Figure 1:
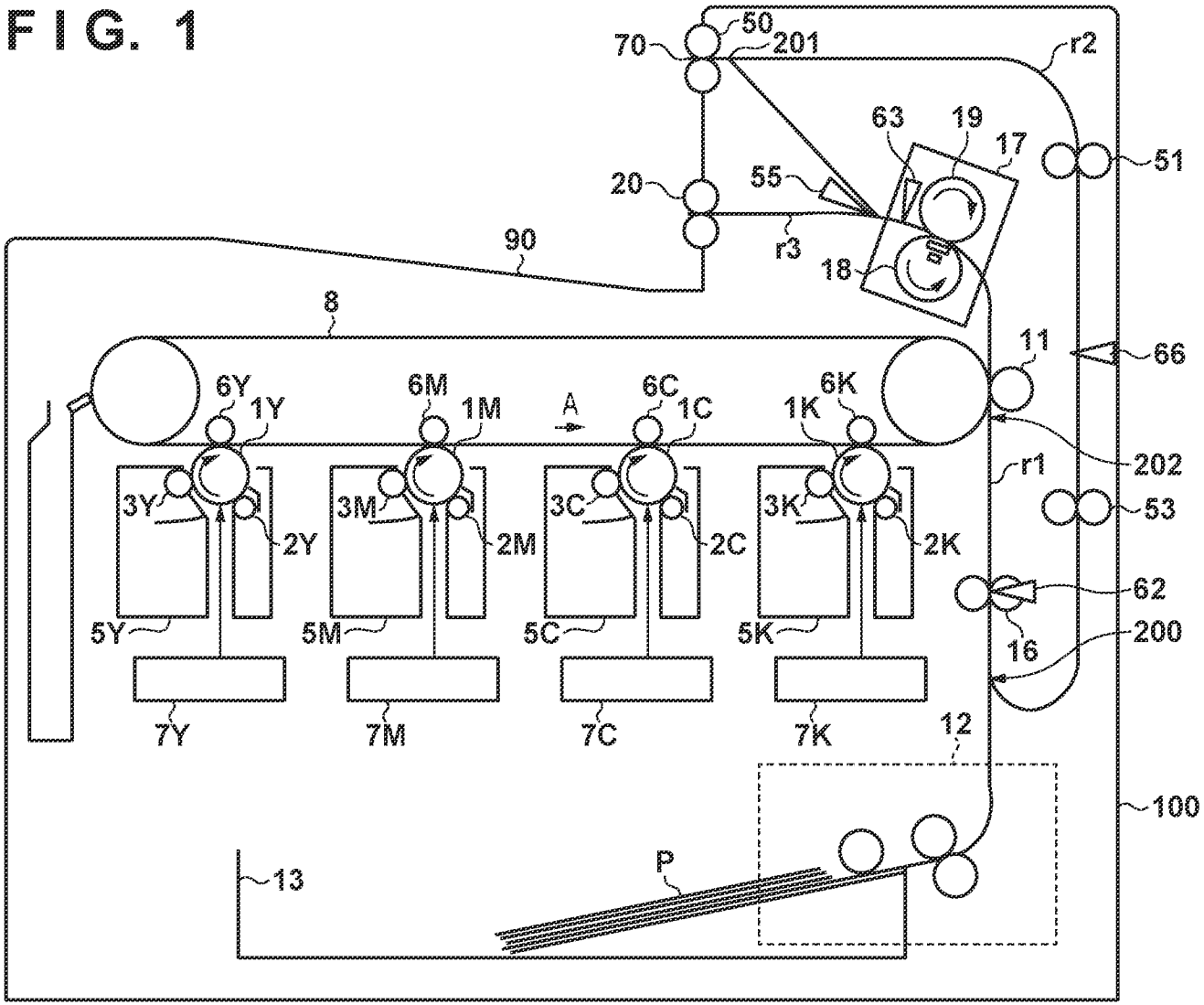
FIG. 1 is a schematic cross-sectional view of an image forming apparatus according to some embodiments.

Hereinafter, embodiments will be described in detail with reference to the attached drawings. Note, the following embodiments are not intended to limit the scope of the claimed invention. Multiple features are described in the embodiments, but limitation is not made to an invention that requires all such features, and multiple such features may be combined as appropriate. Furthermore, in the attached drawings, the same reference numerals are given to the same or similar configurations, and redundant description thereof is omitted.

FIG. 1 is a configuration diagram of an image forming apparatus 100 according to the present embodiment. In FIG. 1, letters Y, M, C, and K at the end of reference numerals indicate that colors of toner images formed by members indicated by the reference numerals are yellow, magenta, cyan, and black. Note that, in a case where colors do not need to be distinguished, reference numerals in which the letters Y, M, C, and K at the end are omitted are collectively used. A photoconductor 1 is rotationally driven in a clockwise direction in the figure in forming an image. A charger 2 charges a surface of a photoconductor 1. An exposure device 7 exposes the photoconductor 1 to form an electrostatic latent image on the photoconductor 1. A developing roller 3 of a developing device 5 develops the electrostatic latent image of the photoconductor 1 with toner to form a toner image on the photoconductor 1. A primary transfer roller 6 transfers the toner image formed on the photoconductor 1 to an intermediate transfer body 8. Note that colors different from yellow, magenta, cyan, and black can be reproduced by superimposing the toner images of the respective photoconductors 1 and transferring the superimposed image to the intermediate transfer body 8.

The intermediate transfer body 8 is rotationally driven in an arrow A direction (counterclockwise direction) in the drawing at the time of image formation. Therefore, the toner image transferred to the intermediate transfer body 8 is conveyed to an opposing position of a secondary transfer roller 11. On the other hand, a feeding device 12 feeds a sheet P stored in a cassette 13 to the main conveyance path r1. The secondary transfer roller 11 transfers the toner image of the intermediate transfer body 8 to the sheet P conveyed along the main conveyance path r1. Hereinafter, a region of the main conveyance path r1 where the toner image is transferred to the sheet P, that is, a nip region between the intermediate transfer body 8 and the secondary transfer roller 11 is referred to as an image forming region or a transfer region.

The registration roller 16 adjusts timing of sending the sheet P to the image forming region so that the toner image of the intermediate transfer body 8 is transferred to the sheet P. Therefore, acceleration/deceleration control for changing the conveying speed of the sheet P from the reference speed is performed by the registration roller 16. Note that the reference speed is a speed serving as a reference in forming an image on the sheet P, which is determined according to the type of the sheet P or the like. For example, the surface speed of the intermediate transfer body 8 is adjusted to a reference speed, and the sheet P is conveyed at the reference speed in the image forming region. Therefore, the acceleration/deceleration control is terminated before the front end of the sheet P reaches an acceleration/deceleration completion point 202 before the image forming region, and the sheet P is conveyed at the reference speed after the front end of the sheet P reaches the acceleration/deceleration completion point 202. A registration sensor 62 that detects the sheet P is provided in the vicinity of the registration roller 16. The detection timing of the sheet P by the registration sensor 62 is used to determine the timing to start the acceleration/deceleration control.

The sheet P to which the toner image has been transferred in the image forming region is conveyed to the fixing device 17. The fixing device 17 includes a fixing roller 18 that heats the sheet P and a pressurizing roller 19 that pressurizes the sheet P toward the fixing roller 18. The fixing device 17 heats and pressurizes the sheet P to fix the toner image on the sheet P. A flapper 55 is provided to control whether or not to branch the sheet P subjected to the fixing process by the fixing device 17 from the main conveyance path r1 to a discharge conveyance path r3. The sheet P on which the image formation is completed is guided to the discharge conveyance path r3 by the flapper 55, and is discharged to a discharge tray 90 by a discharge roller 20. When images are formed on both sides of the sheet P, the sheet P in which the image is formed on the first surface is conveyed toward the reversing roller 50 by the flapper 55. The reversing roller 50 is provided on the downstream side of the branch point 201 in the main conveyance path r1. The branch point 201 is also a start point of the sub conveyance path r2. Hereinafter, a rotation direction in a state where the reversing roller 50 conveys the sheet P to the downstream side of the main conveyance path r1, that is, to the outside of the image forming apparatus via the position 70 is referred to as a "reverse rotation" direction, and a rotation direction opposite to the "reverse rotation" direction is referred to as a "forward rotation" direction. The rotation direction of the reversing roller 50 is switched from the reverse rotation to the forward rotation at a timing after the rear end of the sheet P conveyed to the downstream side of the main conveyance path passes the branching portion 201. Accordingly, the sheet P is sent to the sub conveyance path r2. The timing at which the rotation direction of the reversing roller 50 is switched from the reverse rotation to the forward rotation is determined based on the timing at which the discharge sensor 63 detects the front end or the rear end of the sheet P.

In the sub conveyance path, the sheet P is conveyed by the conveyance roller 51 and the conveyance roller 53, and is again sent to the main conveyance path r1 through the merging point 200. The merging point 200 is on the upstream side of the main conveyance path r1 with respect to the image forming region. Thereafter, the sheet P is again fed into the image forming region, and image formation is performed on a second surface different from the first surface in the image forming region. A double-sided sensor 66 for detecting the sheet P is provided on the sub conveyance path r2.

Figure 2:
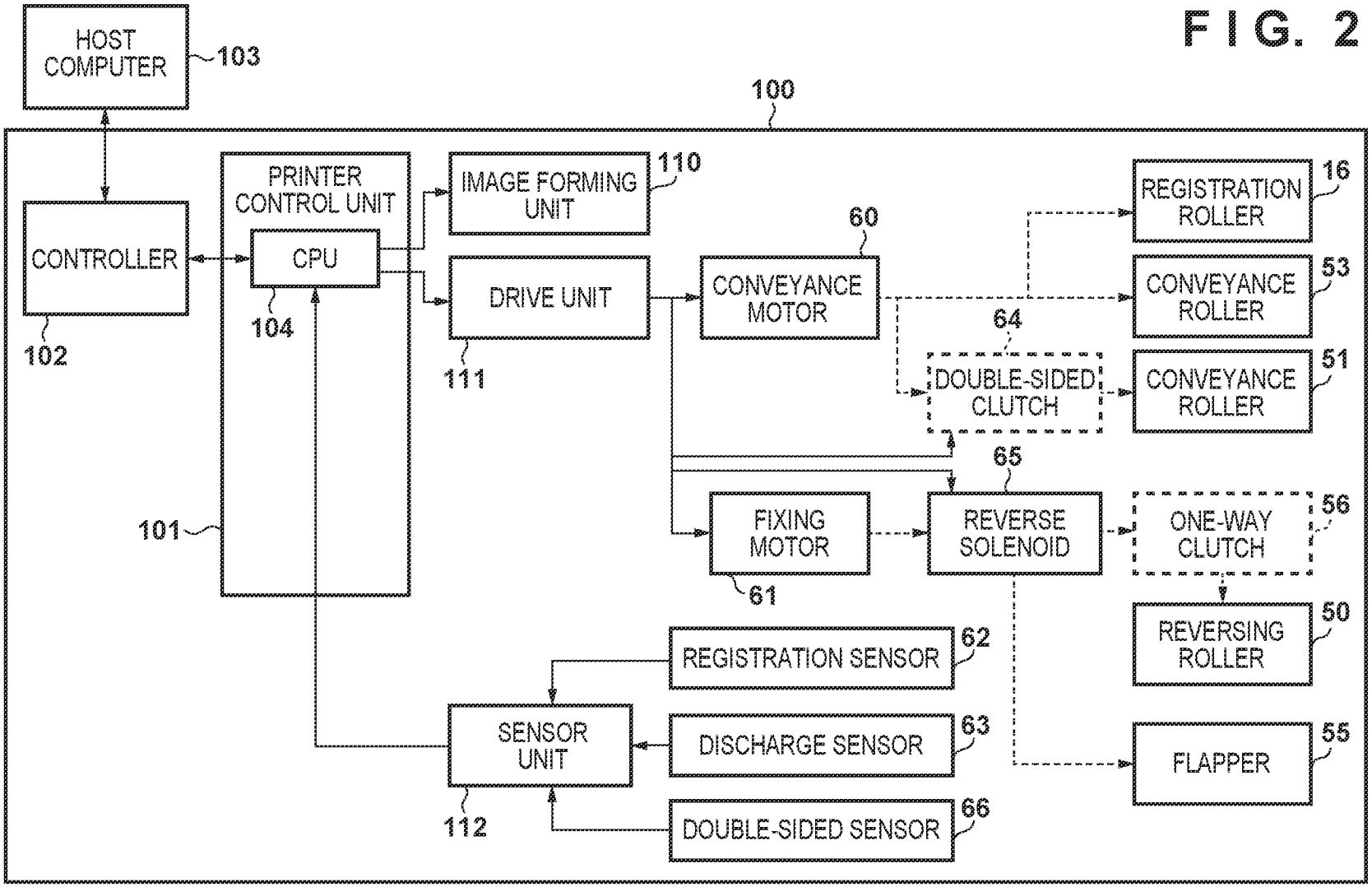
FIG. 2 is a diagram illustrating a control configuration of the image forming apparatus according to some embodiments.

FIG. 2 illustrates a control configuration of the image forming apparatus 100. The controller 102 controls the entire image forming apparatus 100. The controller 102 is connected to a host computer 103 via a network or the like. Upon receiving a print job from the host computer 103, the controller 102 causes the printer control unit 101 to perform image formation in accordance with the print job. The CPU 104 of the printer control unit 101 controls image formation on the sheet P by executing a control program stored in a memory (not illustrated). Note that some or all of the functions handled by the CPU 104 may be implemented by hardware such as an ASIC or an FPGA. The CPU 104 controls an image forming unit 110, a drive unit 111, and a sensor unit 112. The image forming unit 110 is a generic term for the fixing device 17, the exposure device 7, the developing device 5, and the like. The drive unit 111 drives the conveyance motor 60, the fixing motor 61, and the reverse solenoid 65 in accordance with an instruction from the CPU 104. When the optional double-sided clutch 64 is provided, the drive unit 111 also controls the double-sided clutch 64.

The conveyance motor 60 is a drive source of the registration roller 16, the conveyance roller 51, and the conveyance roller 53. When the optional double-sided clutch 64 is provided, the driving force of the conveyance motor 60 is transmitted to the conveyance roller 51 via the double-sided clutch 64. When the double-sided clutch 64 is not provided, the driving force of the conveyance motor 60 is directly transmitted to the conveyance roller 51. The fixing motor 61 is a drive source of the flapper 55 and the reversing roller 50. Note that, although not illustrated in FIG. 2, the fixing motor 61 is also a drive source of the fixing device 17. The driving force of the fixing motor 61 is transmitted to the flapper 55 and the reversing roller 50 via the reverse solenoid 65. Note that the one-way clutch 56 is not provided in the present embodiment. The forward rotation and reverse rotation of the reversing roller 50 are controlled by whether or not the reverse solenoid 65 is driven. The state of the flapper 55 is also controlled by whether or not the reverse solenoid 65 is driven. A motor configured to drive a roller or the like provided in the feeding device 12 is not necessary for the description of the present embodiment, and thus is omitted in FIG. 2.

The sensor unit 112 acquires detection results from the registration sensor 62, the discharge sensor 63, and the double-sided sensor 66, and notifies the CPU 104 of the detection results. The registration sensor 62, the discharge sensor 63, and the double-sided sensor 66 detect whether or not the sheet P is at the predetermined position, but instead of using the sensors, a configuration may be adopted in which whether or not the sheet P is at the predetermined position is determined based on the number of rotations of the motor.

Figure 3A:
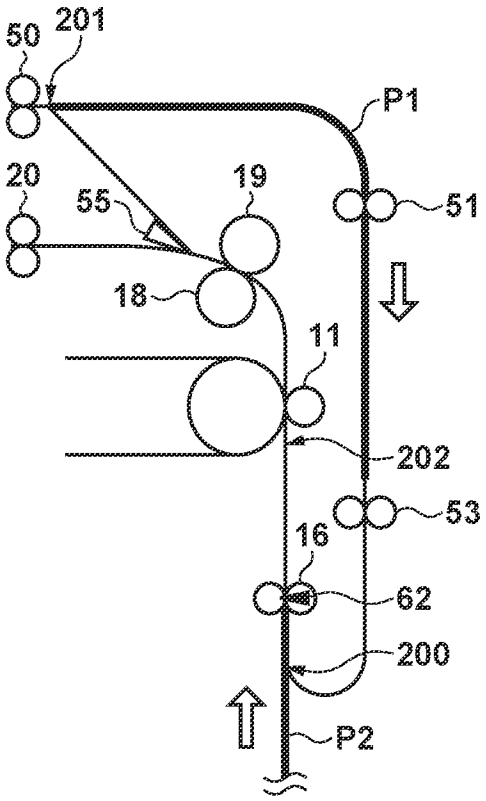
FIGS. 3A to 3C are explanatory diagrams of conveyance mode according to some embodiments.
Figure 3B:
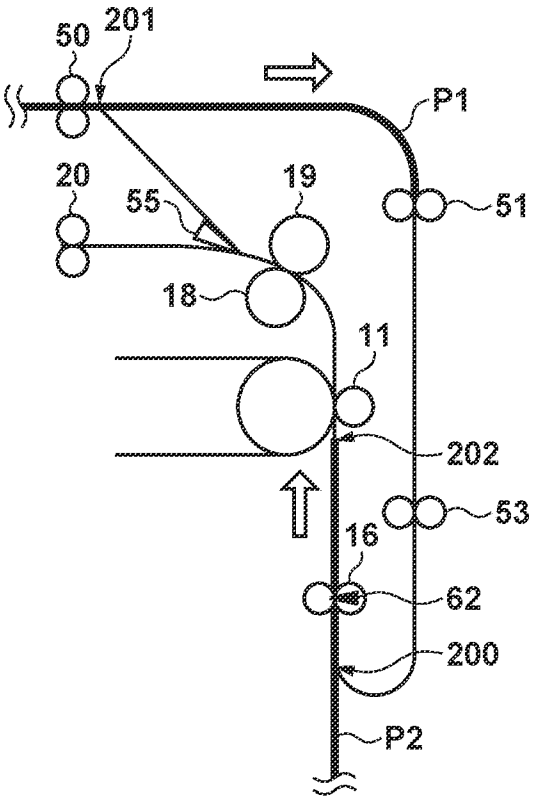
Figure 3C:
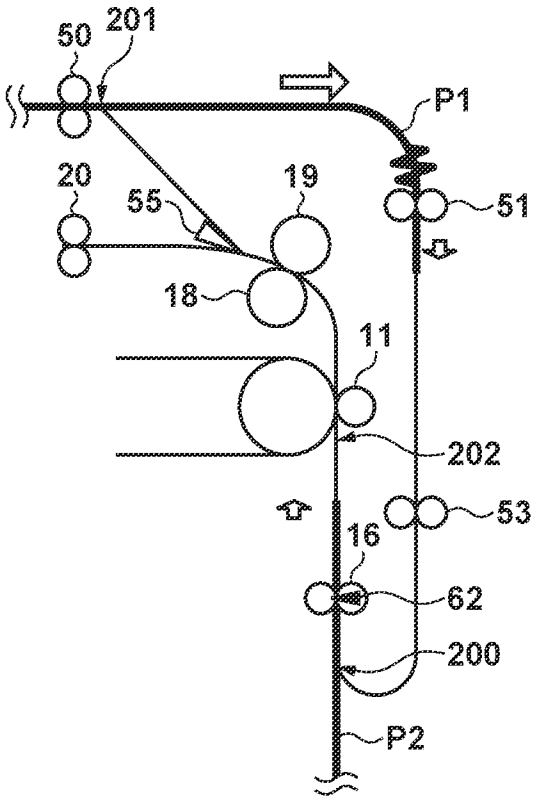

In the present embodiment, when an image is formed on both sides of a sheet, the sheet P is conveyed in one of a plurality of conveyance modes including a first conveyance mode and a second conveyance mode. Hereinafter, the first conveyance mode and the second conveyance mode will be described with reference to FIGS. 3A to 3C. In FIGS. 3A to 3C, the sheet P2 is a sheet fed to the image forming apparatus 100 following the sheet P1. In the first conveyance mode and the second conveyance mode, after an image is formed on the first surface of the sheet P1, an image is formed on the first surface of the sheet P2, and then an image is formed on the second surface of the sheet P1.

FIG. 3A is an explanatory diagram of the first conveyance mode. In the first conveyance mode, the sheet P1 is conveyed toward the sub conveyance path r2 by the reversing roller 50, and the sheet P2 is fed so that the front end of the sheet P2 reaches the registration roller 16 after the rear end of the sheet P1 passes through the reversing roller 50. FIG. 3B is an explanatory diagram of the second conveyance mode. In the second conveyance mode, the sheet P2 is fed such that the front end of the sheet P2 reaches the acceleration/deceleration completion point 202 before the front end of the sheet P1 reaches the conveyance roller 51.

As described above, after the front end of the sheet P2 reaches the registration roller 16, the sheet P2 is subjected to acceleration/deceleration control until the front end reaches the acceleration/deceleration completion point 202. Since the conveyance rollers 51 and 53 and the registration roller 16 are driven by the same conveyance motor 60, the conveying speeds of the conveyance rollers 51 and 53 and the registration roller 16 may be different from the reference speed during the acceleration/deceleration control. On the other hand, since the fixing motor 61 is also a drive source of the fixing device 17, the rotation is controlled at a constant speed, and the conveying speed by the reversing roller 50 is constant at the reference speed. Therefore, as illustrated in FIG. 3C, when acceleration/deceleration control of the sheet P2 is performed while the sheet P1 is being conveyed by the reversing roller 50 and the conveyance roller 51, the sheet P1 may be pulled, pushed, or the like and conveyance failure may occur. In the first conveyance mode, since acceleration/deceleration control of the sheet P2 is performed after the rear end of the sheet P1 passes through the reversing roller 50, conveyance failure of the sheet P1 can be prevented. Similarly, in the second conveyance mode, since the acceleration/deceleration control of the sheet P2 is completed before the front end of the sheet P1 reaches the conveyance roller 51, conveyance failure of the sheet P1 can be prevented.

Figure 4:
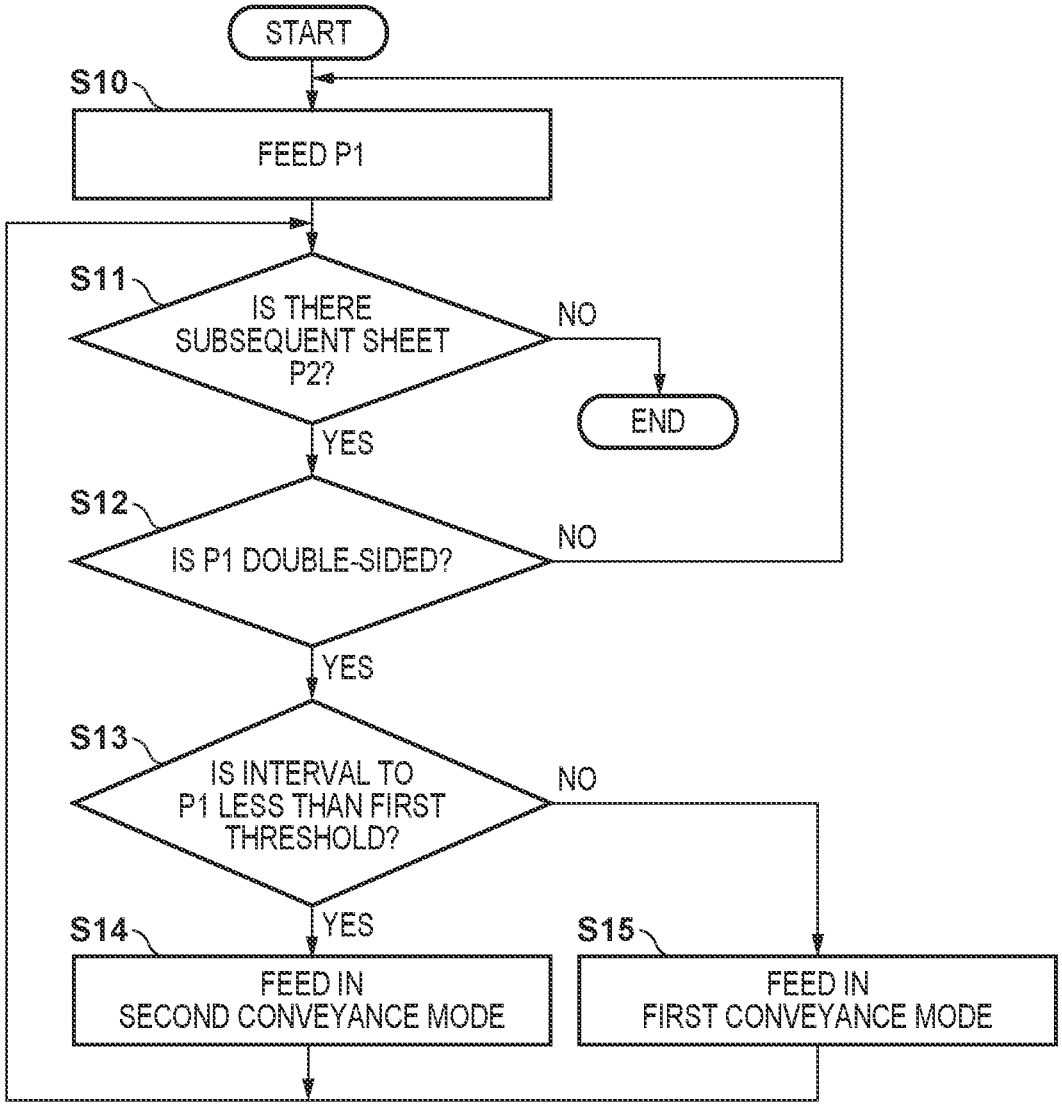
FIG. 4 is a flowchart of a conveyance mode determination process according to some embodiments.

FIG. 4 is a flowchart of a conveyance mode determination process executed by the CPU 104. The process of FIG. 4 is started in response to reception of a print job including a sheet P for forming images on both sides from the host computer 103. Note that FIG. 4 illustrates a flowchart in a case where the length of the sheet P serving as an image forming target in the conveying direction is shorter than a predetermined value. The predetermined value may be the length of the sub conveyance path r2. In S10, the CPU 104 feeds the sheet P1 and forms an image on the first surface of the sheet P1. The CPU 104 determines in S11 whether or not there is a subsequent sheet P2 on which image formation is to be performed following the sheet P1. When there is no subsequent sheet P2, the CPU 104 ends the process of FIG. 4.

When there is a subsequent sheet P2, the CPU 104 determines whether the sheet P1 is a sheet on which images are to be formed on both sides in S12. If the sheet P1 is a sheet on which images are to be formed on both sides, the CPU 104 proceeds the process to the S13. On the other hand, when the sheet P1 is a sheet on which an image is to be formed only on one surface, the CPU 104 repeats the process from S10. When the processes are repeated from S10, the sheet P2 in the previous process becomes the sheet P1 after the repetition, and the sheet fed next to the sheet P2 in the previous process becomes the sheet P2 after the repetition. In S13, the CPU 104 determines whether the feeding interval Tp between the sheets P1 and P2 can be made smaller than the first threshold value. Whether or not the feeding interval Tp between the sheet P1 and the sheet P2 can be made smaller than the first threshold value can be determined based on the timing to start formation of an electrostatic latent image on the photoconductor 1 of an image to be transferred to the sheet P2. When the feeding interval Tp can be made smaller than the first threshold value, the CPU 104 feeds the sheet P2 in the second conveyance mode in S14. That is, the CPU 104 feeds the sheet P2 so as to satisfy the conditions described with reference to FIG. 3B. On the other hand, when the feeding interval Tp cannot be made smaller than the first threshold value, the CPU 104 feeds the sheet P2 in the first conveyance mode in S15. That is, the CPU 104 feeds the sheet P2 so as to satisfy the conditions described with reference to FIG. 3A. Thereafter, the CPU 104 repeats the process from S11.

In order to satisfy the condition described with reference to FIG. 3A, in the case of the first conveyance mode, the feeding interval Tp is set to be larger than or equal to a second threshold value represented by the following formula.

$$\text{Second threshold value} = (L1 + 2 \times L2)/S - T1$$

Here, L1 is a conveying distance from the registration roller 16 to the branch point 201, L2 is a length of the sheet P1 in the conveying direction, and S is a conveying speed of the sheet. T1 is a period from feeding of the sheet P2 until the front end of the sheet P2 reaches the registration roller 16.

The first threshold value is set according to the following formula.

$$\text{First threshold value} = (L3 + L2 + L4)/S - T2$$

Here, L3 is a conveying distance from the acceleration/deceleration completion point 202 to the branch point 201, and L4 is a conveying distance from the branch point 201 to the conveyance roller 51. T2 is a target period from feeding of the sheet P2 until the front end of the sheet P2 reaches the acceleration/deceleration completion point 202. In the case of the second conveyance mode, the CPU 104 controls the conveyance of the sheet P2 so that the front end of the sheet P2 reaches the acceleration/deceleration completion point 202 in the target period T2 or less than the target period T2 after the sheet P2 is fed.

Figure 5A:
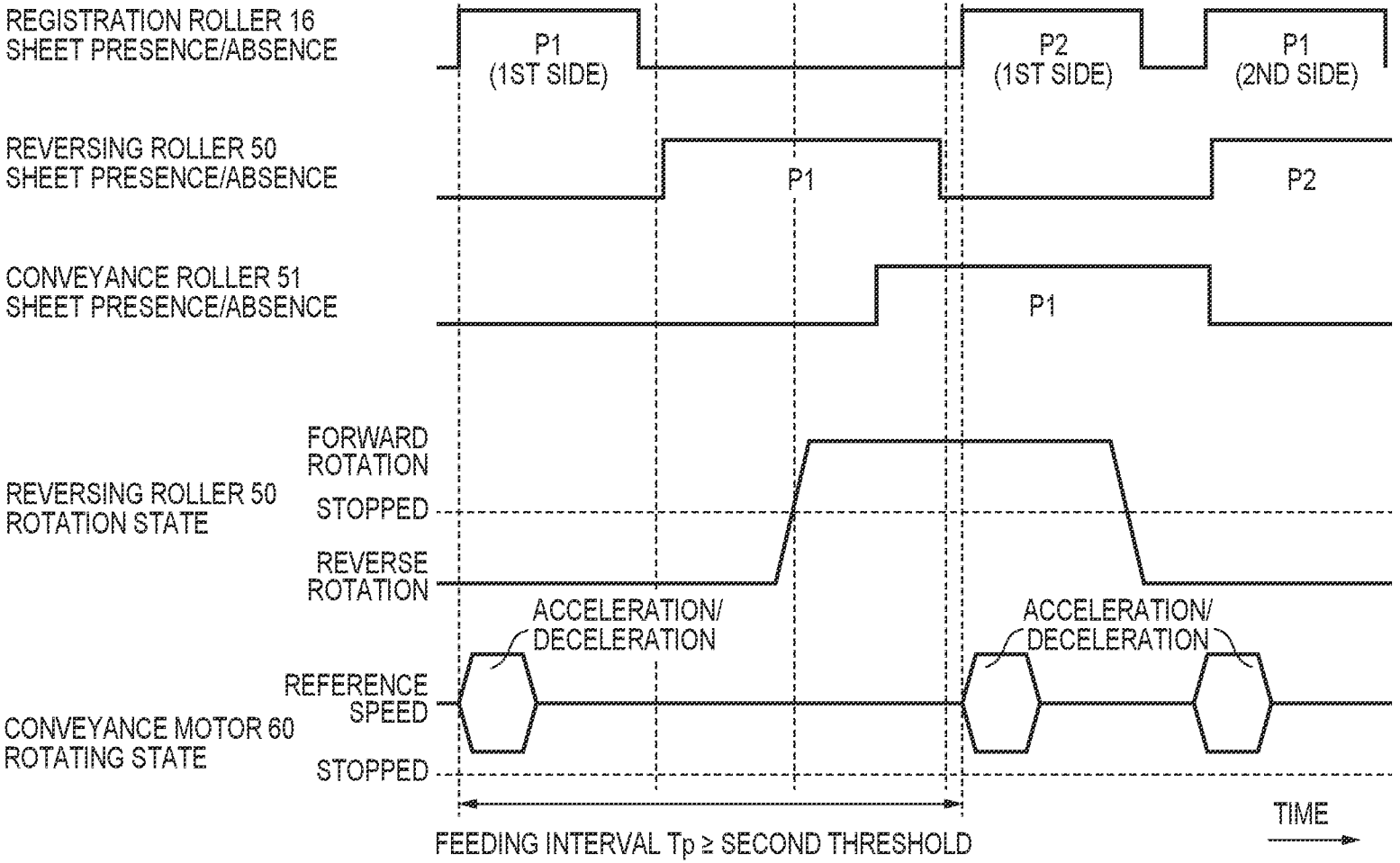
FIG. 5A is an exemplary timing chart of a first conveyance mode.
Figure 5B:
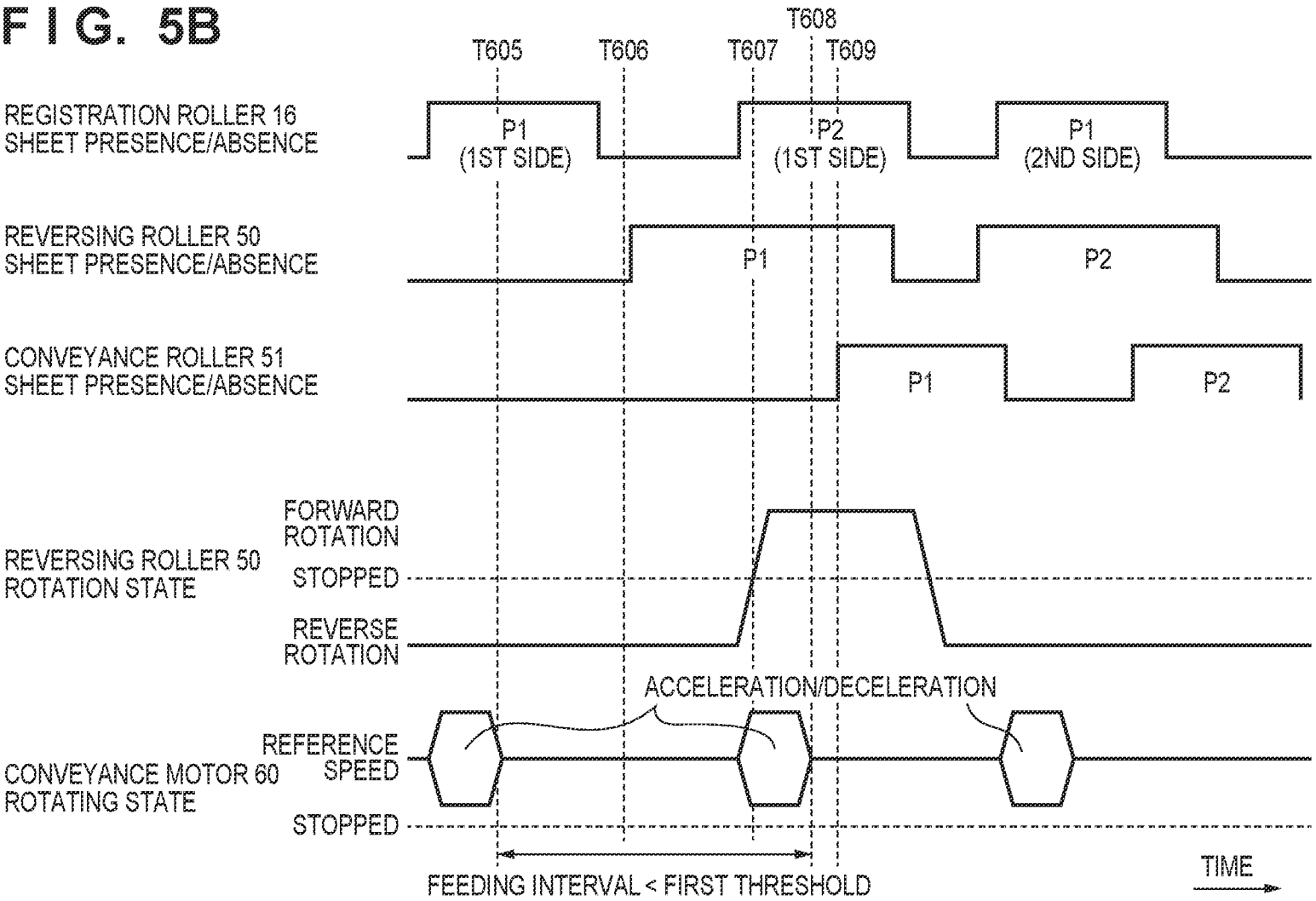
FIG. 5B is an exemplary timing chart of a second conveyance mode.

FIG. 5A is a timing chart in the first conveyance mode, and FIG. 5B is a timing chart in the second conveyance mode. For the presence or absence of a sheet in FIGS. 5A and 5B, the high level indicates "sheet present", and the low level indicates "sheet absent".

First, the first conveyance mode in FIG. 5A will be described. T600 is a timing at which the front end of the sheet P1 reaches the registration sensor 62. Acceleration/deceleration control with respect to the sheet P1 is executed from T600. T601 is a timing at which the front end of the sheet P1 reaches the branch point 201. T602 is a timing at which the rear end of the sheet P1 reaches the branch point 201. At this timing, the reversing roller 50 is switched from the reverse rotation to the forward rotation. T603 is a timing at which the rear end of the sheet P1 reaches the branch point 201. At this time point, the rear end of the sheet P1 has come out of the reversing roller pair 50. T604 is a timing at which the front end of the sheet P2 reaches the registration sensor 62. Acceleration/deceleration control for the sheet P2 is executed from T604. As illustrated in FIG. 5A, in a period in which both the reversing roller 50 and the conveyance roller 51 are "sheet present", the acceleration/deceleration control is not executed, and thus the conveyance failure can be prevented.

Next, the second conveyance mode in FIG. 5B will be described. T605 is a timing at which the front end of the sheet P1 reaches the acceleration/deceleration completion point 202. The acceleration/deceleration control with respect to the sheet P1 is completed by this timing. T606 is a timing at which the front end of the sheet P1 reaches the branch point 201. T607 is a timing at which the rear end of the sheet P1 reaches the branch point 201. At this timing, the reversing roller 50 is switched from the reverse rotation to the forward rotation. T608 is a timing at which the front end of the sheet P2 reaches the acceleration/deceleration completion point 202. The acceleration/deceleration control with respect to the sheet P2 is completed by this timing. T609 is a timing at which the front end of the sheet P1 reaches the conveyance roller 51. As illustrated in FIG. 5B, in a period in which both the reversing roller 50 and the conveyance roller 51 are "sheet present", the acceleration/deceleration control is not executed, and thus the conveyance failure can be prevented.

Figure 6A:
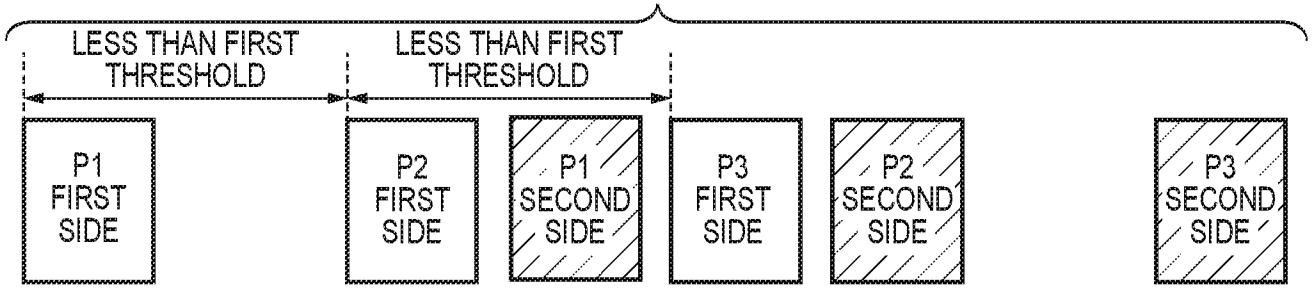
FIGS. 6A to 6C are diagrams illustrating an example of a sheet feeding interval.
Figure 6B:
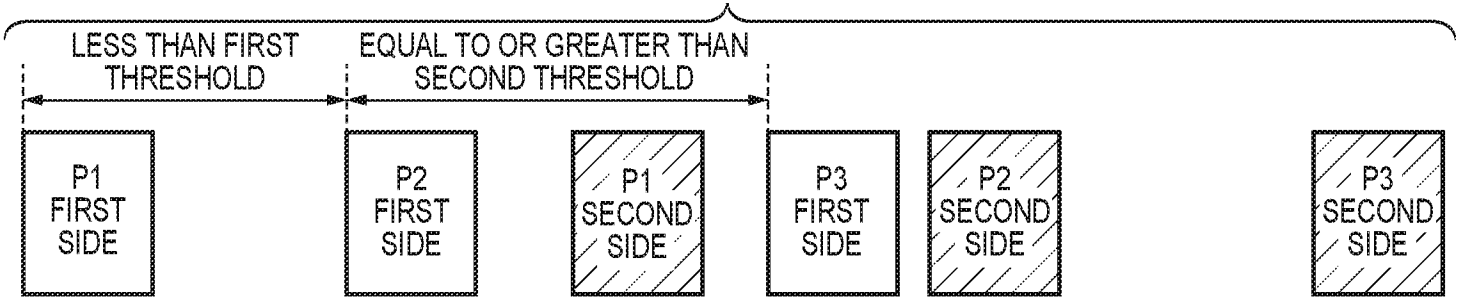
Figure 6C:
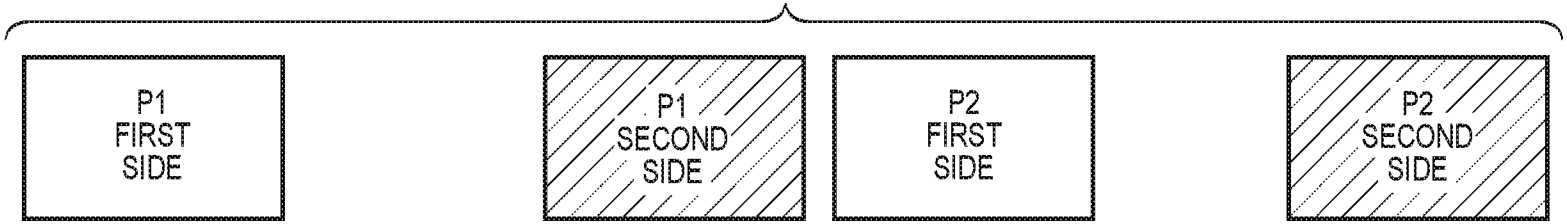

FIGS. 6A to 6C are explanatory diagrams of an example of a feeding interval of sheets according to the present embodiment. FIGS. 6A and 6B illustrate a case where the sheets P are fed in the order of the sheet P1, the sheet P2, and the sheet P3 on which images are to be formed on both sides of the three sheets P. As illustrated in FIGS. 6A and 6B, in a case where the length L2 of the sheet P in the conveying direction is shorter than the length of the sub conveyance path r2, it is possible to perform an operation of forming images on both sides by circulating two sheets in the image forming apparatus 100 (hereinafter referred to as a two-sheet circulating operation). At this time, as illustrated in FIG. 6A, the sheet interval can be shortened and the productivity can be enhanced by using the second conveyance mode.

However, the timing at which the controller 102 transmits image data to the printer control unit 101 may be delayed due to the influence of processing delay of the host computer 103 or the like. For example, as illustrated in FIG. 6B, when the image data of the image formed on the second surface of the sheet P1 is delayed, the feeding interval Tp between the sheet P3 and the sheet P2 cannot be made to smaller than the first threshold value. In this case, as illustrated in FIG. 6B, the CPU 104 sets the sheet P3 to the first conveyance mode, that is, the feeding interval Tp between the sheet P2 and the sheet P3 to greater than or equal to the second threshold value to avoid the conveyance failure. As described above, at the normal time, the second conveyance mode is used, and the first conveyance mode is used when the feeding interval Tp with the preceding sheet cannot be made to smaller than the first threshold value, whereby the occurrence of conveyance failure can be suppressed without reducing productivity.

When the length L2 of the sheet P in the conveying direction is larger than a predetermined value, for example, the length of the sub conveyance path r2, the preceding sheet P1 and the subsequent sheet P2 collide with each other at the branch point 201 or the merging point 200, and thus the two-sheet circulating operation cannot be used. In this case, as illustrated in FIG. 6C, a one-sheet circulating operation, in which the subsequent sheet P is fed after image formation on both sides of one sheet P is completed. In the case of the one-sheet circulating operation, since the preceding sheet P is not in the sub conveyance path r2 at the time point of executing the acceleration/deceleration control of the subsequent sheet P, conveyance failure due to a difference in conveying speed between the reversing roller 50 and the conveyance roller 51 does not occur.

In the present embodiment, until the front end of the sheet P reaches the registration roller 16, the sheet P is conveyed at the reference speed and then the acceleration/deceleration control is performed. However, until the front end of the sheet P reaches the registration roller 16, the sheet P may be conveyed at a conveying speed different from the reference speed, the acceleration/deceleration control is performed, and then the sheet P is returned to the reference speed and sent to the image forming region. Furthermore, the conveyance of the sheet P conveyed through the sub conveyance path r2 can be temporarily interrupted. This can be done by providing an optional double-sided clutch 64 and controlling the double-sided clutch 64 to block the transmission of the driving force to the conveyance roller 51. The timing at which the conveyance of the sheet P is interrupted can be determined based on the timing at which the double-side sensor 66 detects the front end of the sheet P.

Second Embodiment

The following describes a second embodiment mainly about differences from the first embodiment. In the present embodiment, the one-way clutch 56 illustrated in FIG. 2 is provided. Therefore, the driving force of the fixing motor 61 is transmitted to the reversing roller 50 via the reverse solenoid 65 and the one-way clutch 56. When the conveying speed of the conveyance roller 50 becomes faster than the conveying speed of the reversing roller 51 and a force is applied to the reversing roller 51 when the sheet P is conveyed to the downstream side of the sub conveyance path r2 by the reversing roller 50 and the conveyance roller 50, the one-way clutch 56 blocks the driving force to the reversing roller 50. For example, when the acceleration/deceleration control is started while the sheet P is conveyed by the reversing roller 50 and the conveyance roller 51, and the conveying speed by the conveyance roller 51 becomes faster than the reference speed, the one-way clutch 56 blocks the driving force to the reversing roller 50 so that the occurrence of conveyance failure can be suppressed.

Figure 7:
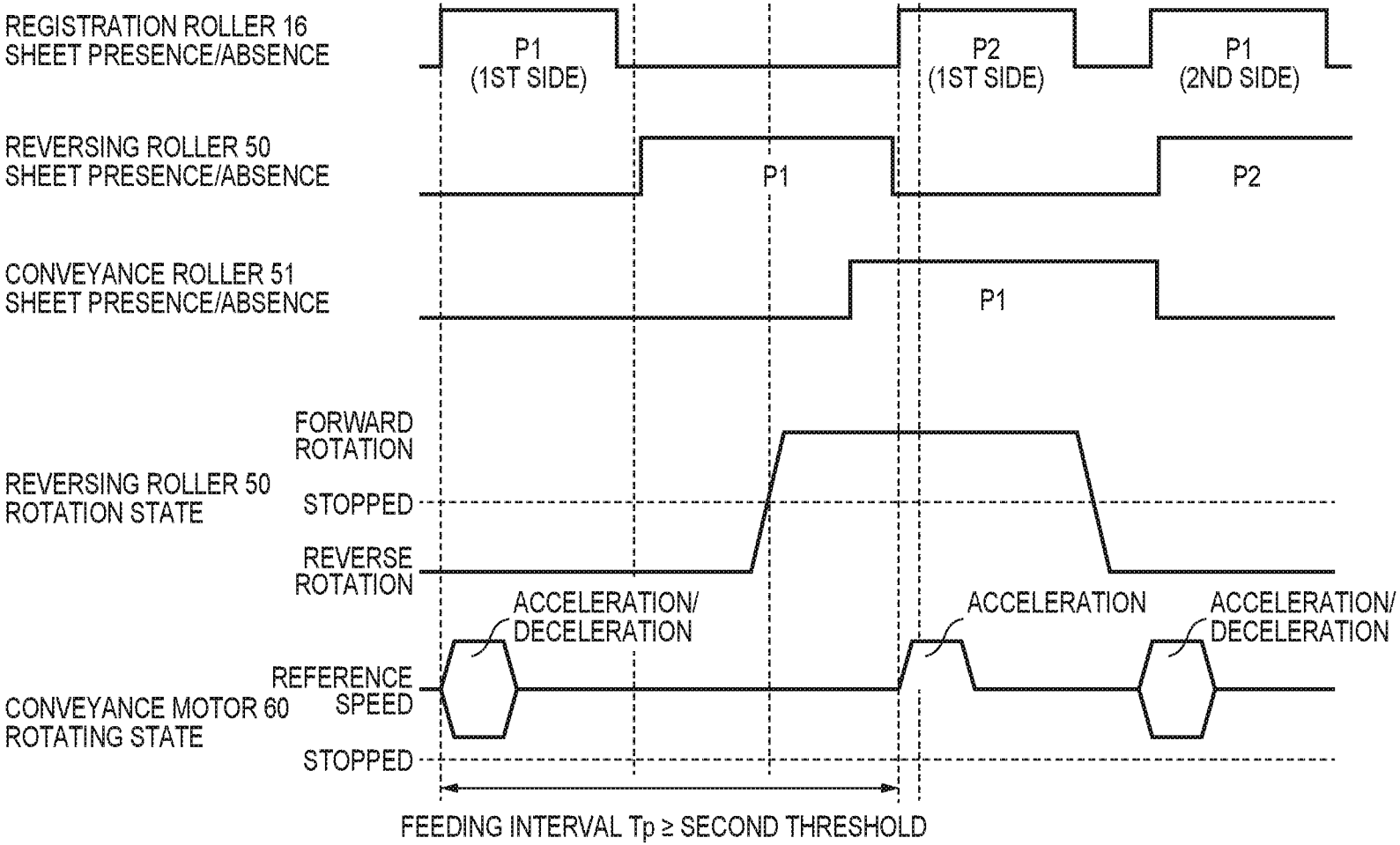
FIG. 7 is an exemplary timing chart of the first conveyance mode.

FIG. 7 is an exemplary timing chart of the first conveyance mode in the present embodiment. Note that description on parts similar to those in FIG. 5A will be omitted. T700 of FIG. 7 is a timing at which the front end of the sheet P2 reaches the registration sensor 62. In FIG. 5A, the timing T604 at which the front end of the sheet P2 reaches the registration sensor 62 is later than the timing T603 at which the rear end of the sheet P1 reaches the branch point 201, but in the present embodiment, T700 is timing before T603.

In the present embodiment, the feeding timing of the sheet P2 is delayed from the timing according to the image formation start timing. Therefore, in the acceleration/deceleration control of the sheet P2 started from the timing of T700, the conveying speed of the sheet P2 is faster than the reference speed but is not slower. Therefore, in FIG. 7, the acceleration/deceleration control of the sheet P2 is executed in a period in which the sheet P1 is conveyed by both the reversing roller 50 and the conveyance roller 51, but in this case, the driving force to the reversing roller 50 is blocked by the one-way clutch 56. Therefore, the occurrence of conveyance failure can be suppressed.

As described above, the driving force to the reversing roller 50 can be blocked by the one-way clutch 56. In the case of the first conveyance mode, the feeding timing of the sheet P2 is controlled so that the conveying speed of the sheet P2 does not become slower than the reference speed in the acceleration/deceleration control with respect to the sheet P2. With this configuration, reduction in productivity can be suppressed while avoiding conveyance failure. In the present embodiment, unlike the first embodiment, unless the conveying speed of the sheet P2 in the acceleration/deceleration control of the sheet P2 becomes slower than the reference speed, a state in which the sheet P is conveyed by the reversing roller 50 and the conveyance roller 51 is allowed. That is, the condition of the feeding interval Tp described in the first embodiment is not necessarily satisfied. However, the feeding interval Tp may be controlled so as to satisfy the condition of the feeding interval Tp described in the first embodiment.

Third Embodiment

Figure 8:
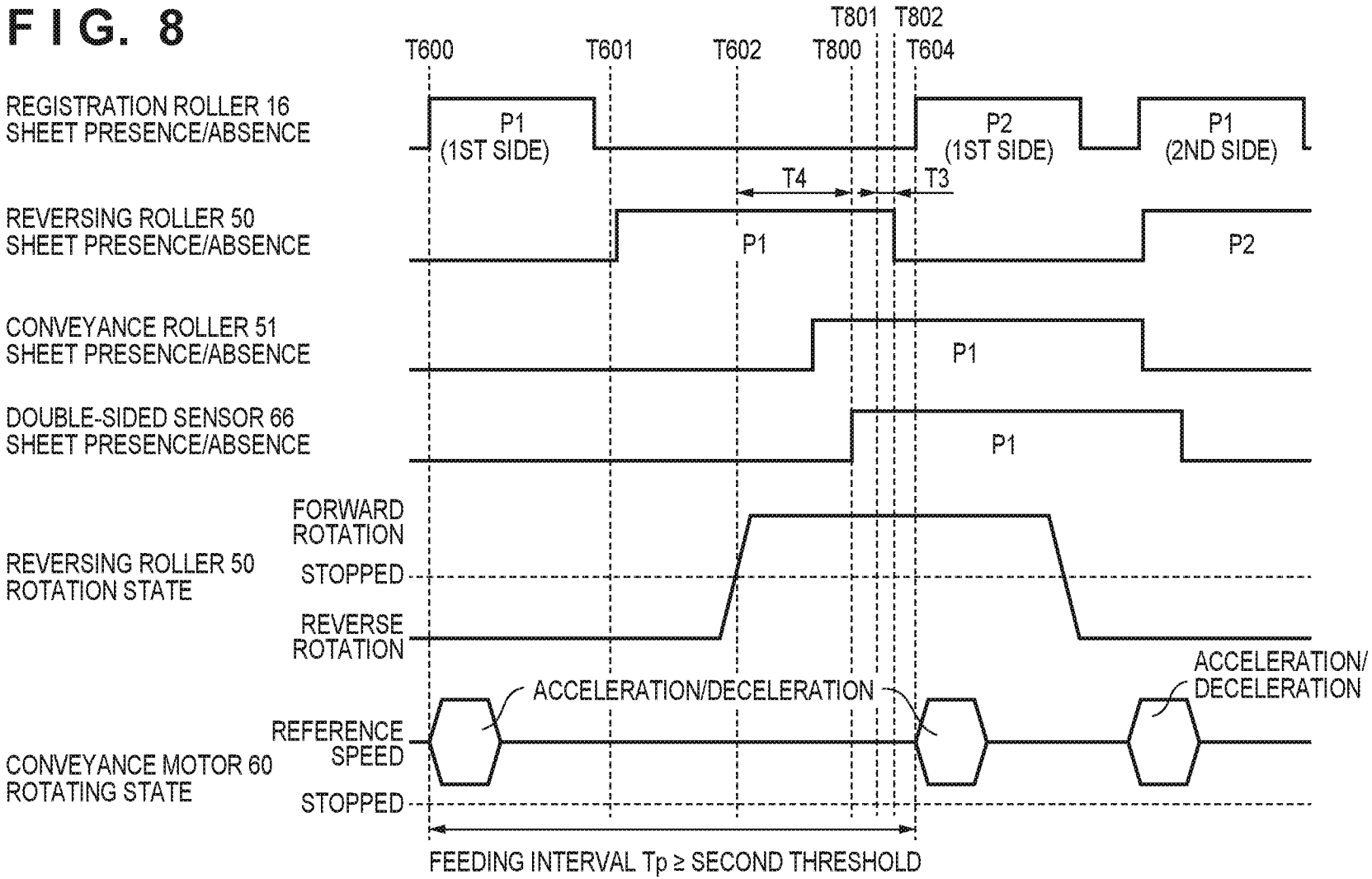
FIG. 8 is an exemplary timing chart of the first conveyance mode.

Next, a third embodiment will be described focusing on differences from the first and second embodiments. FIG. 8 is an exemplary timing chart of the first conveyance mode in the present embodiment. Note that description on parts similar to those in FIG. 5A will be omitted. T800 in FIG. 8 is a timing at which the front end of the sheet P1 is detected by the double-sided sensor 66. Furthermore, T801 is a timing at which the rear end of the sheet P1 reaches the branch point 201, which is obtained from the number of rotations of the reversing roller 50 and the like, and corresponds to T603 in FIG. 5A. T802 is a timing at which the rear end of the sheet P1 actually reaches the branch point 201.

FIG. 8 illustrates a state in which a slip or the like occurs in conveyance of the sheet P1 by the reversing roller 50 due to wear or the like of the reversing roller 50, and the timing at which the rear end of the sheet P1 actually reaches the branch point 201 is delayed from the timing assumed by the CPU 104. In such a situation, unless the second threshold value for determining the feeding interval between the sheet P2 and the sheet P1 is set to be larger than the value described in the first embodiment, the acceleration/deceleration control of the sheet P2 can be performed during a period in which the sheet P1 is conveyed by both the reversing roller 50 and the conveyance roller 51.

Therefore, the CPU 104 measures the conveyance time T4 from the timing T602 when the reversing roller 50 is changed from the reverse rotation to the forward rotation to the timing T800 when the front end of the sheet P1 is detected by the double-sided sensor 66, and compares the conveyance time T4 with a predetermined reference time to determine a delay time T3. In this manner, the CPU 104 functions as a measurement unit that measures the conveyance time T4. The reference time can be, for example, a design time from the timing when the reversing roller 50 is changed from the reverse rotation to the forward rotation to when the front end of the sheet P1 is detected by the double-sided sensor 66, or a time based on an actually measured time. The delay time T3 can be, for example, a time or based on a time obtained by subtracting the reference time from the conveyance time T4. For example, the CPU 104 greatly updates the second threshold value in the first embodiment by the delay time T3, and controls the feeding of the sheet P2 such that the feeding interval Tp1 of the sheet P2 with respect to the sheet P1 becomes greater than or equal to the updated second threshold value.

In addition to the second threshold value with respect to the feeding interval Tp in the first conveyance mode, the first threshold value with respect to the feeding interval Tp in the second conveyance mode can also be updated so as to be increased by the delay time T3. In the present embodiment, the delay time T3 is determined based on the detection result of the double-sided sensor 66, but the delay time T3 may be determined based on the detection result of the registration sensor 62.

As described above, the occurrence of the conveyance failure can be suppressed while suppressing reduction in productivity by determining the delay amount with respect to the assumed value of the conveyance time of the sheet P based on the detection result of the sensor and controlling the feeding interval Tp based on the delay amount.

As described above, in the conveyance path of the image forming apparatus 100 including the main conveyance path r1 and the sub conveyance path r2, for example, a plurality of rollers such as the reversing roller 50 for conveying the sheet P are provided along the conveyance path. Here, instead of arranging one roller at each position of the conveyance path to convey the sheet P, as illustrated in FIG. 1, two rollers may be arranged on opposite sides of the conveyance path at each position to convey the sheet P. That is, for each roller such as the reversing roller 50 in the above description, two rollers can be formed as one set "roller pair".

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2023-024623, filed Feb. 20, 2023, which is hereby incorporated by reference herein in its entirety.

What is claimed is:

1. An image forming apparatus comprising:

a main conveyance path having an image forming region;

a sub conveyance path connecting a branch point on a downstream side of the image forming region and a merging point on an upstream side of the image forming region in the main conveyance path;

a feeding unit configured to feed a sheet to the main conveyance path;

an image forming unit configured to form an image on the sheet conveyed on the main conveyance path in the image forming region of the main conveyance path;

a first roller configured to send the sheet to the image forming region;

a second roller configured to be rotationally driven in a first direction until a rear end of the sheet in a conveying direction passes beyond the branch point, and rotationally driven in a second direction different from the first direction after the rear end has passed the branch point, to send the sheet to the sub conveyance path;

a third roller configured to convey the sheet toward the merging point in the sub conveyance path;

a first drive source configured to drive the first roller and the third roller;

a second drive source configured to drive the second roller; and a control unit configured to control the first drive source, the second drive source, and the feeding unit;

wherein the control unit is configured to perform a first control of changing a conveying speed of the sheet by the first roller from a reference speed in order to adjust timing at which the sheet reaches the image forming region until a front end of the sheet in the conveying direction reaches a first position between the first roller and the image forming region, and control the first drive source so that the conveying speed of the sheet becomes the reference speed after the front end has reached the first position; and the control unit is configured to control a feeding timing to the main conveyance path of a second sheet to be fed to the main conveyance path by the feeding unit after a first sheet so that the first control is not executed while the first sheet is being conveyed in the sub conveyance path by both the second roller and the third roller.

2. The image forming apparatus according to claim 1, wherein the control unit sets the feeding timing of the second sheet to be before a first timing in a case where the second sheet is feedable to the main conveyance path before the first timing, and sets the feeding timing of the second sheet to be a second timing or after the second timing in a case where the second sheet is not feedable to the main conveyance path before the first timing; and the second timing is later than the first timing.

3. The image forming apparatus according to claim 2, wherein the first timing is determined based on a third timing at which the front end of the first sheet reaches the third roller and a fourth timing at which the front end of the second sheet fed to the main conveyance path by the feeding unit reaches the first position.

4. The image forming apparatus according to claim 3, wherein the first timing is a latest timing that satisfies a condition that the fourth timing is earlier than the third timing.

5. The image forming apparatus according to claim 2, wherein the second timing is determined based on a third timing at which the first sheet changes from a state of being conveyed by the second roller to a state of not being conveyed by the second roller, and a fourth timing at which the front end of the second sheet fed to the main conveyance path by the feeding unit starts to be conveyed by the first roller.

6. The image forming apparatus according to claim 5, wherein the second timing is an earliest timing that satisfies a condition that the fourth timing is later than the third timing.

7. The image forming apparatus according to claim 1, wherein in a case where a length of the first sheet in the conveying direction is shorter than a predetermined value, the control unit controls the feeding timing of the second sheet to feed the second sheet to the main conveyance path before the first sheet is returned to the main conveyance path via the merging point, and in a case where the length of the first sheet in the conveying direction is the predetermined value or is longer than the predetermined value, the control unit feeds the second sheet to the main conveyance path after the first sheet is returned to the main conveyance path via the merging point.

8. The image forming apparatus according to claim 7, wherein the predetermined value is a value based on a length of the sub conveyance path from the branch point to the merging point.

9. The image forming apparatus according to claim 1, wherein the driving force of the second drive source is transmitted to the second roller via a blocking unit, and the blocking unit is configured to block the driving force transmitted from the second drive source to the second roller when a conveying speed by the third roller becomes faster than a conveying speed by the second roller when the first sheet is conveyed on the sub conveyance path by both the second roller and the third roller.

10. The image forming apparatus according to claim 9, wherein the blocking unit is a one-way clutch.

11. The image forming apparatus according to claim 1, further comprising:

a measurement unit configured to measure a conveyance time from when a rotation direction of the second roller that conveys the sheet is changed from the first direction to the second direction until the sheet reaches a predetermined position on the sub conveyance path or the main conveyance path; wherein the control unit is configured to control the feeding timing of the second sheet to the main conveyance path using a difference between the conveyance time and a reference time when the conveyance time measured by the measurement unit is longer than the reference time.

12. An image forming apparatus comprising:

a main conveyance path having an image forming region;

a sub conveyance path connecting a branch point on a downstream side of the image forming region and a merging point on an upstream side of the image forming region in the main conveyance path;

a feeding unit configured to feed a sheet to the main conveyance path;

an image forming unit configured to form an image on the sheet conveyed on the main conveyance path in the image forming region of the main conveyance path;

a first roller configured to send the sheet to the image forming region;

a second roller configured to be rotationally driven in a first direction until a rear end of the sheet in a conveying direction passes beyond the branch point, and rotationally driven in a second direction different from the first direction after the rear end has passed the branch point, to send the sheet to the sub conveyance path;

a third roller configured to convey the sheet toward the merging point in the sub conveyance path;

a first drive source configured to drive the first roller and the third roller;

a second drive source configured to drive the second roller;

a blocking unit configured to block a driving force of the second drive source from being transmitted to the second roller; and a control unit configured to control the first drive source, the second drive source, and the feeding unit;

wherein the control unit is configured to perform a first control of changing a conveying speed of the sheet by the first roller from a reference speed in order to adjust timing at which the sheet reaches the image forming region until a front end of the sheet in the conveying direction reaches a first position between the first roller and the image forming region, and control the first drive source so that the conveying speed of the sheet becomes the reference speed after the front end has reached the first position; and the control unit is configured to control a feeding timing to the main conveyance path of a second sheet to be fed to the main conveyance path by the feeding unit after a first sheet so that the conveying speed of the second sheet does not become slower than the reference speed in the first control executed while the first sheet is being conveyed on the sub conveyance path by both the second roller and the third roller.

* * * * *